US005874372A

United States Patent [19]

Morishita et al.

[11] Patent Number: 5,874,372

[45] Date of Patent: Feb. 23, 1999

[54] HIGHLY STRETCHABLE FABRICS AND PROCESS FOR PRODUCING SAME

[75] Inventors: Rokuro Morishita; Hiroshi Yasuda, both of Otsu; Mitsura Seto, Osaka; Hisao Nishinaka, Osaka; Taizo Ikezawa, Osaka, all of Japan

[73] Assignee: Toyo Boseki Kabushiki Kaisha, Osaka-fu, Japan

[21] Appl. No.: 959,042

[22] Filed: Oct. 28, 1997

[30] Foreign Application Priority Data

Oct. 30, 1996 [JP] Japan ..... 8-288559
Jan. 10, 1997 [JP] Japan ..... 9-002753

[51] Int. Cl.[6] ..... D03D 3/00

[52] U.S. Cl. ..... 442/182; 28/155; 28/165; 139/421; 442/199

[58] Field of Search ..... 442/182, 199; 139/421; 28/155, 165

[56] References Cited

FOREIGN PATENT DOCUMENTS 7-160429 6/1995 Japan .

*Primary Examiner*—James J. Bell
*Attorney, Agent, or Firm*—Kenyon & Kenyon

[57] ABSTRACT

The invention provides a highly stretchable fabric having an elongation percentage of 5 to 45% and a recovery percentage of elongation of at least 70% and comprising spun yarns serving at least as warps or wefts, the fabric being characterized in that the spun yarns contain two-component composite fibers comprising a highly shrinkable polyester component A and a polyester component B less shrinkable than the polyester component A, the composite fibers being so oriented that in the vicinity 5 of the crests of weaving crimps of the spun yarn, the polyester component A faces toward the inner side of the crimps. The invention also provides a process for producing the fabric. The fabric is excellent in stretchability and recovery from elongation and is capable of retaining its appearance and hand.

17 Claims, 2 Drawing Sheets

HIGHLY STRETCHABLE FABRICS AND PROCESS FOR PRODUCING SAME

BACKGROUND OF THE INVENTION

The present invention relates to fabrics prepared from spun yarns and having high stretchability and excellent in recovery from elongation, and to a process for producing such fabrics.

Fabrics for clothes, especially those for uniforms and sporting garments usually must be excellent in stretchability and elongation in view of requirements as to the function and fitness.

Natural rubber has been long used for imparting stretchability to fabrics as is known. It is practice in recent years to use textured yarns of polyester, nylon or the like, or stretchable polyurethane elastic yarns to give stretchability to fabrics. It is also practice to use core-spun yarns comprising a core of such a textured yarn or polyurethane elastic yarn, and covered yarns obtained by winding filaments around a core. Further known is the chemical stretch process wherein cotton yarns are swollen by an alkali treatment, then subjected to an external force and thereby given a higher percentage of crimp. JP-A-150429/1995 proposes a fabric prepared from spun yarns which contain at least 70 wt. % of composite fibers comprising a copolymerized polyester and a polyester composed substantially of ethylene terephthalate units, the copolymerized polyester consisting primarily of ethylene terephthalate units which contain 2 to 7 mole % of 2,2-bis[4-(2-hydroxyethoxy)phenyl]propane and 5 to 13 mole % of isophthalic acid as comonomers.

However, the use of natural rubber involves the problem that the rubber thread is thick and therefore gives an increased thickness to the fabric to result in limited use. The fabric obtained also has problems with respect to the durability and uneven stretchability due to the embrittlement of natural rubber.

The use of covered yarns encounters the problem that the covering operation increases the number of steps required to entail a higher cost and necessitates sophisticated techniques, for example, for tension control for weaving. Further the use of polyurethane entails the problem of embrittlement due to insufficient resistance to light and heat, etc.

The chemical stretch process is limited in elongation percentage and recovery percentage of elongation. The technique disclosed in the foregoing publication, i.e., JP-A-150429/1995, has the problem that the fabric is as low as up to 18% in elongation percentage and is not suited to prevalent use as a stretchable fabric.

The object of the present invention, which has been accomplished to overcome the foregoing problems, is to provide a fabric which is prepared from spun yarns and which is nevertheless excellent in stretchability and recovery from elongation, soft, plump, lightweight, elastic, and further capable of retaining its appearance and hand, and to provide a process for producing the fabric.

SUMMARY OF THE INVENTION

To fulfill the above object, the present invention provides a highly stretchable fabric having an elongation percentage of 5 to 45% and a recovery percentage of elongation of at least 70% and comprising spun yarns serving at least as warps or wefts, the spun yarns containing two-component composite fibers comprising a highly shrinkable polyester component A and a polyester component B less shrinkable than the polyester component A, the composite fibers being so oriented that in the vicinity of the crests of weaving crimps of the spun yarn, the polyester component A faces toward the inner side of the crimps.

Preferably, the spun yarns contain the two-component composite fiber in an amount of at least 55 wt. %.

The two-component composite fibers are preferably eccentric composite fibers.

Preferably, at least 60% of the two-component fibers are so oriented as stated above.

Preferably, the eccentric composite fibers are composite fibers wherein the highly shrinkable polyester component A and the less shrinkable polyester component B are joined in the form of a bimetal.

The highly shrinkable polyester component A can be a copolymerized polyester formed from an aromatic dicarboxylic acid and a fatty acid and/or aromatic diol and composed of units at least 80% of which are ethylene terephthalate units. The less shrinkable polyester component B can be a copolymerized polyester less shrinkable than the highly shrinkable polyester component A and consisting primarily of polyethylene terephthalate or ethylene terephthalate units.

The highly shrinkable polyester component A can be a copolymerized polyester consisting primarily of ethylene terephthalate units and comprising 1 to 3 mole % of component units having a metal salt sulfonate group and 2 to 10 mole % of isophthalic acid as copolymer components. The less shrinkable polyester component B can be a copolymerized polyester less shrinkable than the polyester component A and consisting primarily of polyethylene terephthalate or ethylene terephthalate units.

Preferably, the eccentric composite fibers are polyester composite fibers having a latent crimping property and at least 5% in dry heat shrinkage percentage in dry heat of 160° C. under a load of 36 mg/d and at least 40/inch in the number of crimps to be produced when heat-treated in dry heat at 160° C. with no load applied thereto.

Preferably, the spun yarn is at least 20% in dry heat shrinkage percentage at 160° C.

The spun yarn can be a stretchable slub yarn.

More preferably, the fabric can be 20 to 45% in elongation percentage.

Preferably, the fabric is 50 to 800 g/m$^2$ in weight and 0.15 to 2.4 mm in thickness.

To achieve the foregoing object, the present invention further provides a process for producing a highly stretchable fabric which process comprises the steps of preparing spun yarns containing at least 55 wt. % of composite fibers having a latent crimping property and comprising a polyester component A and a polyester component B less shrinkable than the polyester component A, preparing a fabric ranging from 10 to 35 in the coefficient of basic density represented by Equation (2) given below with use of the spun yarns at least as warps or wefts so that the weight proportion of the spun yarns in the entire fabric is 25 wt % to 100 wt. %, and heat-treating the fabric at least before, during or after dyeing in wet heat of at least 125° C. or dry heat of at least 160° C. in a tension-free state, the spun yarns being 3.2 to 4.7 in the twist constant determined from Equation (1) given below when the spun yarns are single yarns, or 3.2 to 4.7 in the twist constant of first twist and 0.5 to 1.5 times the first twist constant in the twist constant of final twist in the same direction as the first twist when the spun yarns are plied yarns.

$$\text{Twist constant} = T/(Ne)^{1/2} \quad (1)$$

wherein T is the twist number per inch of the spun yarns, and Ne is the English count of the spun yarns.

$$\text{Coefficient of basic density} = \{2n/(2\,(Nw)^{1/2}) + St/(2\,(Nt)^{1/2})\} \times T/St + \{2n/(2\,(Nt)^{1/2}) + Sw/(2\,(Nw)^{1/2})\} \times W/Sw \quad (2)$$

wherein n is the number of the crossover points, i.e., the point of the warp and weft, in one cycle, Nt is the count of the warps, Nw is the count of the wefts, T is warp density (yarns/inch), W is weft density (yarns/inch), St is the number of warps in one cycle, and Sw is the number of wefts in one cycle.

The fabric is in the tension-free state preferably by being overfed by plus 10% in both warp and weft directions.

Preferably, the process further includes the step of processing the fabric to achieve a reduction of up to 40% at least before or after the heat-treating step.

The eccentric composite fibers can be polyester composite fibers at least 5% in dry heat shrinkage percentage at 160° C. under a load of 36 mg/d and at least 40/inch in the umber of crimps to be produced by a heat treatment at 160° C. with no load applied thereto.

Preferably, the spun yarns are at least 20% in dry heat shrinkage percentage at 160° C.

DETAILED DESCRIPTION OF THE PREFERRED EMBODIMENTS

Embodiment 1

Figure 1:
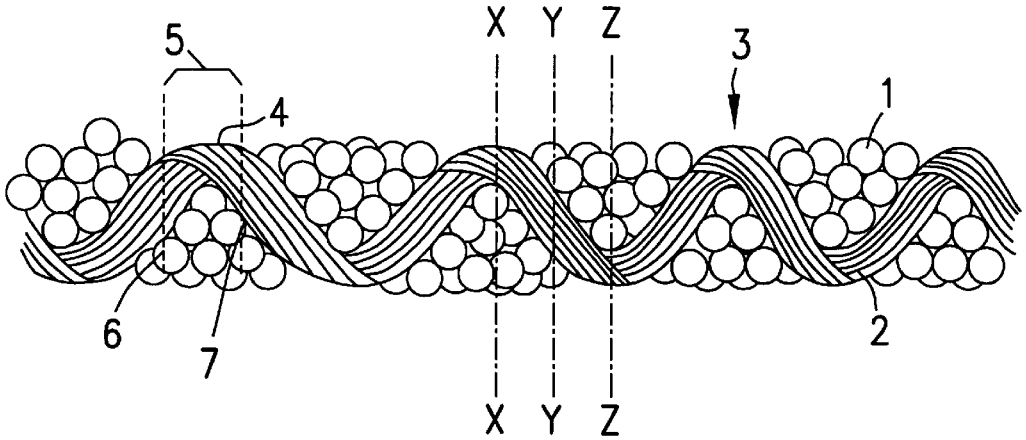
FIG. 1 is a view in section of a highly stretchable fabric embodying the invention.
Figure 2:
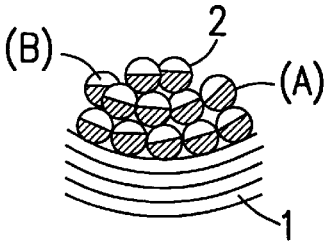
FIG. 2 is a view in section taken along the line X—X in FIG. 1.
Figure 3:
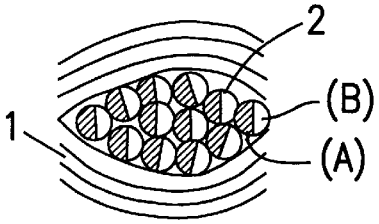
FIG. 3 is a view in section taken along the line Y—Y in FIG. 1.
Figure 4:
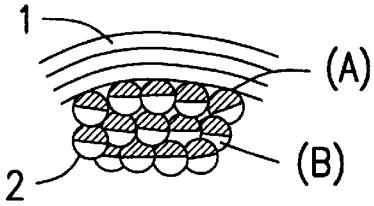
FIG. 4 is a view in section taken along the line Z—Z in FIG. 1.

With reference to the accompanying drawings, a description will be given of a highly stretchable fabric as the first of the preferred embodiments of the invention. FIG. 1 is a transverse view in vertical section of the fabric. The drawing shows warps 1 and wefts 2. FIGS. 2, 3 and 4 are views in section taken respectively along the line X—X, the line Y—Y and the line Z—Z in FIG. 1.

The highly stretchable fabric according to the present embodiment is prepared from spun yarns serving at least as warps or wefts and having an elongation percentage of 5 to 45% and a recovery percentage of elongation of at least 70%. If the yarns are less than 5% in elongation percentage, the fabric is insufficient in fitness and is therefore difficult to stretch. When the elongation percentage is over 45%, the points of intersection of yarns decrease in number to result in a lower recovery percentage of elongation. Further in view of hand, the elongation percentage is preferably 20 to 45% because if the elongation percentage is less than 20%, suitable drape is not available, failing to give a feeling of lightweightness to the wearer, and also because if the percentage is in excess of 45%, the fabric has excessive drape and feels heavy when worn.

The recovery percentage of elongation should be at least 70%. If the percentage is less than 70%, the fabric becomes impaired in shape retentivity. The recovery percentage is more preferably 80 to 98%.

The spun yarns each contain two-component composite fibers comprising a highly shrinkable polyester component A and a polyester component B less shrinkable than the component A. As shown in FIGS. 2 and 4, a majority of the composite fibers are so oriented that in the vicinity of the crests of weaving crimps of the spun yarn, the highly shrinkable polyester component A faces toward the inner side of the crimps. Preferably, at least 60% of the number of composite fibers are thus oriented.

The term the "weaving crimps" refers to the waviness produced in at least one of the warp and the weft by interlacing warps and wefts to form a fabric (see FIG. 1). Further with reference to FIG. 1, the term the "crests 4 of weaving crimps" refers to the portions of the crimps corresponding to the crossover points of yarns of the fabric, i.e., to the apexes of the waveform of the crimps (meaning both the upward apexes and the downward apexes). The term the "vicinity 5 of the crest of weaving crimp" refers to the region (point 6 to point 7 in FIG. 1) of the warp or weft which includes the crest of the crimp and extends therefrom in opposite directions along the yarn over a distance corresponding to ¼ of the distance from one crimp crest to another crimp crest adjacent thereto.

The orientation of a major portion of the polyester component A toward the inner side of the weaving crimps in the vicinity of the crests thereof is given by weaving spun yarns containing eccentric composite fibers of a latent crimping property into a fabric and processing the fabric as specified later. More specifically, the fabric is processed as relaxed to thereby enlarge the spaces between the eccentric composite fibers forming the yarns. In this way, the composite fibers can be so oriented as stated above in the most stable crimped state of orientation within the yarn, when developing the latent crimping property.

When thus oriented, the eccentric composite fibers conform to the weave of the fabric, exhibiting satisfactory recovering ability when stretched. The polyester component A is more shrinkable than the polyester component B and therefore generally has a lower melting point than the component B. With the eccentric composite fibers, the polyester component B is selectively oriented outwardly of the weaving crimps, i.e., outwardly of the fabric. Accordingly, the fabric incorporating the oriented composite fibers can be rendered free of surface faults, i.e., mark of press (resembling the trace of ironing) and undesirable gloss, that would occur when pressed by ironing under severe conditions as to temperature, pressure, steam, treating time and pressing method, whereby the hand of the fabric can be effectively prevented from hardening.

Thus, the orientation of the polyester component A in the eccentric composite fibers, as well as improved stretchability, is essential to the maintenance of the appearance as a quality product and the desired hand. If the number of composite fibers oriented is less than 60%, the composite fibers fail to exhibit the inherent crimping property, consequently failing to give the fabric the contemplated recovery percentage of elongation. More preferably, at least 70% of the composite fibers have the orientation.

The weight of the fabric is also a factor influencing the elongation and the recovery percentage of the fabric. When less than 50 g/m$^2$ in weight, the fabric is greatly diminished in the numbers of warps and wefts, and the points of intersection of the yarns become loosened to result in a lower recovery percentage of elongation. On the other hand, if the weight exceeds 800 g/m$^2$, the yarns intersect one another at a greatly increased number of points to clog up the fabric. Further limitations encountered in weaving make the fabric harder to entail a lower recovery percentage. The weight is preferably in the range of 100 to 500 g/m $^2$.

Preferably, the fabric has a thickness ranging from 0.15 to 2.4 mm. If the thickness is smaller than 0.15 mm, the spun yarns to be used must be thinner, consequently impairing the stretchability of the fabric. Conversely, if the thickness is over 2.4 mm, there arises a need to greatly increase the thickness of the spun yarns, with the result that the fabric obtained exhibits impaired hand although stretchable. The fabric is more preferably in the range of 0.25 to 1.70 mm in thickness.

It is desired that the spun yarns contain at least 55 wt. % of eccentric composite fibers based on the entire fabric because if the content is less than 55%, the fibers will not be crimped fully within the spun yarns under the restraint involved in the twisting step.

The spun yarns, which are in the form of single yarns or plied yarns, are present preferably in an amount of 25 to 100 wt. % based on the entire fabric. If the content of spun yarns is less than 25%, sufficient stretchability is unavailable. More preferably, the entire fabric contains 35 to 100 wt. % of spun yarns.

The spun yarns may be blended or twisted as plied yarns, within the range less than 45 wt. , with a synthetic fiber such as usual polyester fiber, semisynthetic fiber such as acetate fiber, regenerated fiber such as rayon or polynosic fiber, or natural fiber such as wool or hemp fiber. The product can then be given hand or function which is characteristic of the individual materials.

The twist constant of the spun yarns as determined from Equation (1) given below is preferably in the following range. When the spun yarns are single yarns, the twist constant is preferably in the range of 3.2 to 4.7. When the spun yarns are plied yarns, it is desired that the first twist constant of the constituent single yarns forming the plied yarn be 3.2 to 4.7, and that the single yarns be twisted together in the same direction as the first twist, with a final twist constant corresponding to 0.5 to 1.5 times the first twist constant.

The twist number of the single yarn, and the first twist number of the constituent single yarns of the plied yarn are 3.2 to 4.7 because if the twist number is less than 3.2, the restraining force between the fibers is then small, failing to give the fabric the desired recovery percentage and strength. On the other hand, if the number is in excess of 4.7, the restraining force between the fibers becomes excessive, failing to afford a sufficient elongation percentage and further hardening the hand of the fabric. The twist number of the single yarn as the spun yarn and the first twist number of each constituent single yarn forming the plied yarn is more preferably in the range of 3.2 to 4.2.

The spun yarn which is in the form of a plied yarn should have a final twist constant of the above range because if the constant is less than 0.5 times, the yarn fails to have a round cross section and to retain the component fibers as satisfactorily bundled. If the constant is over 1.5 times, an excessive restraining force will act between the constituent single yarns to result in an insufficient elongation percentage, further giving impaired hand to the fabric. The final twist constant is more preferably 0.7 to 1.3 times the first twist constant of the constituent single yarn, in the same direction as the first twist.

$$\text{Twist constant}=T/(Ne)^{1/2} \quad (1)$$

wherein T is the twist number per inch of the spun yarns, and Ne is the English count of the spun yarns.

It is desired that the fabric according to the present embodiment be in the range of 10 to 35 in the coefficient of basic density calculated from Equation (2) given below. When this coefficient is less than 10, the fabric is coarse-textured, has impaired hand and is greatly diminished in the numbers of warps and wefts, permitting the yarns to intersect with one another loosely to entail a reduced recovery percentage of elongation. If the coefficient exceeds 35, on the other hand, a compacted fabric will be formed with a structure of increased restraining force and with an insufficient crimping effect. The increased restraining force further leads to impaired hand, and a marked increase in the number of points of intersection of yarns permits clogging, while the limitation encountered in weaving gives rise to the problem that the fabric becomes hard and less stretchable. The coefficient of basic density is more preferably in the range of 15 to 33.

$$\text{Coefficient of basic density} = \{2n/(2\,(Nw)^{1/2}) + St/(2\,(Nt)^{1/2})\} \times T/St + \{2n/(2\,(Nt)^{1/2}) + Sw/(2\,(Nw)^{1/2})\} \times W/Sw \quad (2)$$

wherein n is the number of the crossover points of yarns in one cycle, Nt is the count of the warps, Nw is the count of the wefts, T is warp density (yarns/inch), W is weft density (yarns/inch), St is the number of warps in one cycle, and Sw is the number of wefts in one cycle.

If the foregoing requirements are not fulfilled, it becomes impossible to orient the composite fibers, presenting difficulty in preparing a fabric of high stretchability and outstanding hand.

The highly stretchable fabric according to the present embodiment is produced by the process to be described below.

First, spun yarns are prepared which contain at least 55 wt. % of eccentric composite fibers having a latent crimping property. The composite fibers are used in order to obtain fibers which are given a higher elastic recovery percentage by a heat treatment following weaving and to prepare a fabric of improved stretchability and recovery percentage. Preferably the composite fibers are at least 5% in dry heat shrinkage at 160° C. under a load of 36 mg because satisfactory crimping characteristics are unavailable if the shrinkage is below 5%.

It is also desired that the eccentric composite fibers be not smaller than 40/inch in the number of crimps to be produced when heat-treated at 160° C. free of load. If the number of crimps to be produced under this condition is less than 40/inch, the fabric is lower in elongation percentage and recovery percentage of elongation. Although the upper limit of the number of crimps can be altered variously, the number is preferably up to 65/inch in view of processability for spinning and the hand of the fabric product to be obtained. The number is more preferably at least 50/inch from the viewpoint of obtaining a fabric which is excellent especially in stretchability and recovery percentage of elongation.

It is further desired that the composite fibers be mechanically given 3 to 15 crimps/inch so as to prevent impairment of spinnability due to the development of the latent crimping property in the spinning step, especially in the opening and picking step, or carding step. The crimping is also intended to prevent neps and unopened portions from remaining in the fibers.

The eccentric composite fibers can be of the so-called side-by-side type or of the core-sheath eccentric type. The fibers of the former type are preferable in view of the stretchability.

Usable as the highly shrinkable polyester component A is, for example, a copolymerized polyester formed from an aromatic dicarboxylic acid and a fatty acid and/or aromatic diol and composed of units at least 80% of which are ethylene terephthalate units. Preferably, the polyester component A can be a copolymerized polyester consisting primarily of ethylene terephthalate units and comprising 1 to 3 mole %, preferably 1.5 to 2.7 mole %, of component units having a metal salt sulfonate group and 2 to 10 mole %, preferably 3 to 8 mole %, of isophthalic acid as copolymer components.

The less shrinkable polyester component B can be a copolymerized polyester less shrinkable than the polyester component A and consisting primarily of polyethylene terephthalate or ethylene terephthalate units. Composite fibers wherein the polyester component A and the polyester component B are joined as arranged side by side are usable as the eccentric composite fibers having a latent crimping property.

With the composite fiber according to the present embodiment, the highly shrinkable polyester component A contains component units having a metal salt sulfonate group as a desirable copolymer component as stated above, whereby the polyester component A is given more excellent elastic recovery property after spinning and drawing than the polyester component B. In the vicinity of the crests of the weaving crimps, therefore, the composite fiber is bent with one side thereof positioned inward in which side the highly shrinkable polyester component A is present.

The polyester component A contains isophthalic acid in addition to the component units having the metal salt sulfonate group as previously stated above, so that the highly shrinkable component can be given a greater heat shrinkage percentage than when the component units comprise the metal salt sulfonate group only, consequently increasing the difference in heat shrinkage between the component A and the less shrinkable component B. This improves the latent crimping function and dry strength of the composite fiber. The expression that the polyester component B is less shrinkable than the polyester component A means that when the polymers of these components are individually spun into threads, the thread of the polyester component B is smaller than the thread of the polyester component A by at least 5% in dry heat shrinkage at 160° C. under a load of 36 mg/d.

The proportion of the component unit having the metal salt sulfonate group and to be copolymerized for giving the polyester component A is preferably 1 mole % to 3 mole %. If the proportion is less than 1 mole %, insufficient elastic recovery will result after drawing to entail lower latent crimping property, whereas proportions in excess of 3 moles % render the composite fiber insufficient in dry strength.

The amount of isophthalic acid to be copolymerized for affording the polyester component A is preferably in the range of 2 mole % to 10 mole %. If the amount is less than 2 mole %, the heat shrinkage difference between the polyester components A and B is smaller than is required to result in an insufficient latent crimping property. When the amount is in excess of 10 mole %, on the other hand, insufficient elastic recovery will result after drawing to an unsatisfactory latent crimping function. Other copolymerized components can of course be present in the polyester components A and B insofar as the object and advantage of the present invention are ensured. Property imparting agents or additives such as antibacterial agents, deodorants, flame retardants, dyes, pigments and ceramics can be incorporated as desired into one or both of the polyester components A and B.

It is important that the spun yarns be at least 20% in shrinkage percentage in dry heat of 160° C. When the shrinkage is less than 20%, the spun yarns develop insufficient latent crimping when mildly heat-treated in the subsequent step, giving lower stretchability to the fabric.

The spun yarns, thus prepared in the form of single yarns or plied yarns, are used at least as warps or wefts to produce a fabric. The fabric is so formed as to satisfy the foregoing requirement as to the coefficient of basic density and to comprise 25 wt. % to 100 wt. % of spun yarns based on the entire fabric. When the fabric is to be given stretchability in the warp direction, the spun yarns are used as warps. The fabric is preferably a twill fabric or satin fabric.

Subsequently, it is required to treat the fabric in wet heat of at least 125° C. or dry heat of at least 160° C. in a free state (tension-free state) at least before or after dyeing. In view of the efficiency, it is desirable to conduct the heat treatment at 125° C. to 140° C. in the case of wet heat, or at 160° C. to 180° C. in the case of dry heat. It is further effective that the fabric be heat-treated immediately after weaving without giving any thermal history.

It is desired to overfeed the fabric by at least plus 10%, preferably by at least plus 20%, when to be free in the warp direction, or by at least plus 10%, preferably by plus 10% to plus 50%, when to be held in the free state in the weft direction. The fabric is thus held free for the heat treatment so as not to prevent the development of the shrink and crimp to be produced in the spun yarns by the heat treatment, that is, in order to give improved mobility to the component A in the eccentric composite fibers and to orient the composite fibers effectively. The heat treatment thus effected causes the composite fibers to almost completely develop the latent crimping function, minimizing the likelihood of the latent function remaining in the fibers. If the overfeed ratio is less than plus 10% in the warp direction or in the weft direction, the heat treatment fails to fully develop shrunk portions and crimped portions, impairing the elongation percentage, recovery percentage and fastness of the fabric, hence undesirable results.

The heat treatment can be carried out later in other processing steps. Under a controlled temperature condition, the treatment can conducted both in dry heat and in wet heat.

It is further desired to process the fabric for a reduction of up to 40%, preferably 5% to 20%, before or after the heat treatment to ensure adjusted hand. The fabric can thereafter be subjected to a raising treatment. When thus treated, the fabric is made usable for a wide variety of applications.

Unless the production process described above is resorted to, the composite fibers in the fabric can no longer be oriented as specified, consequently failing to provide a fabric which is outstanding in stretchability and hand.

The present invention will be further described with reference to the following examples wherein highly stretchable fabrics were prepared.

Example 1

The test methods will be described first which were used in the present example and comparative example.

(1) Staple fineness (d: denier)

Determined according to JIS(Japanese Industrial Standard) L 1015/7.5, Method A. An amount of sample was placed on flock paper placed on a cutting table, with the fibers laid in parallel using a metal comb. The sample as pulled straight with a suitable force was pressed against a gauge plate, and cut to a length of 30 mm with a cutting blade for safety razors or the like to prepare a set of 300 fibers. (The fibers, when short, were cut to a length of 20 mm to prepare a set of 450 fibers.) The mass of the set was measured to determine the apparent fineness D' (denier). The fineness based on corrected mass D (denier) was calculated from the following equation using the equilibrium moisture percentage Re (%) separately measured. The fineness was expressed in terms of the average (calculated down to the second decimal place) of five calculated values.

$$D(\text{denier})=D'\times(100+Rc)/(100+Re)$$

wherein Rc is the official moisture percentage (%).

(2) Number of crimps in staple (per inch)

Determined according to the method of JIS L 1015/7.12. The fibers of the sample, measuring 25 mm in length and as loosened, were individually adhered at their opposite ends to smooth-surfaced paper. The sample was then attached to a suspending device, with clamps thereof spaced apart by a suitable distance. The paper having the sample affixed thereto was cut, a load of 50 mg/d was thereafter applied to the sample, and the distance L between the clamps was measured. The sample was then removed from the device, held suspended in a dryer at a temperature of 160° C. for 30 minutes, subsequently withdrawn from the dryer, allowed to cool to room temperature, and thereafter subjected to the same load as above to measure the distance L' between the clamps. Using the values L and L', the number of crimps was given by:

$$[(L-L')/L]\times 100.$$

(3) Dry heat shrinkage percentage of spun yarn

The sample spun yarn was attached to a suspending device with the distance between its clamps set to 50 cm. With a load of 140 mg/d applied to the spun yarn, the distance H between the clamps was measured. The spun yarn was then removed from the device, held suspended in a dryer at a temperature of 160° C. for 30 minutes, thereafter taken out from the dryer, allowed to cool, and subjected to the same load as above to measure the distance H' between the clamps. Using the values H and H', the dry heat shrinkage percentage was given by:

$$[(H-H')/H]\times 100.$$

(4) Material mixing ratio (%)

The mass of polyester included in the sample fabric was measured according to the method of JIS L 1030. More specifically, the fabric was separated into spun yarns, which were then untwisted and separated into loose short fibers by a twist tester. The composite polyester fibers were then separated off as highly crimped fibers and checked for mass. The ratio of the mass to the entire mass was expressed as the mixing ratio of the material.

(5) Weight (g/m$^2$)

Measured according to the method of JIS L 1096/6.5. More specifically, the mass of the sample fabric in the standard state was measured to express the mass per square meter as the weight.

(6) Thickness (mm)

Determined according to the method of JIS L 1096/6.5. More specifically, the measurement obtained by subjecting the sample to a pressure of 240 gf/cm$^2$ for 10 seconds was expressed as the thickness.

(7) Elongation percentage

Determined according to JIS L 1096/6.14, Method B (Constant Load Method). More specifically, a test piece, 5 cm×30 cm, was set on a tensile tester, a load of 1.5 kgf was gently applied to the test piece, and the test piece was allowed to stand for 1 minute. The resulting length L1 was then measured. The elongation percentage was given by:

$$[(L1-L0)/L0]\times 100$$

wherein L0 is the original length.

(8) Recovery percentage of elongation

Determined according to JIS L 1096/6.14, Method B (Constant Load Method). More specifically, the test piece was set on the tester in the same manner as in the determination of elongation percentage described above, a load of 1.5 kgf was gently applied to the test piece, and the test piece was allowed to stand for 1 hour and thereafter checked for the resulting length L1. The test piece was subsequently allowed to stand free of load for 1 hour, subjected to the same load again and checked for the resulting length L2. Using the lengths L1 and L2, the recovery percentage was given by:

$$[(L1-L2)/(L1-L0)]\times 100.$$

(9) Stretchability

A sensory test was conducted by ten panelists. In the tables to follow, the stretchability is evaluated according to the criteria of: "100% satisfactory" as represented by a circle mark, "70–99% satisfactory" by a triangle mark, and "less than 70% satisfactory" by a cross mark.

(10) Fiber section orientation

Five fabric pieces were collected from different portions of the sample fabric, packaged with a resin for fixing and microtomed to prepare slices, which were then observed under an optical microscope at a magnification of ×40 to ×500. Under the condition in which the polyester component A was identified in the fabric surface and fiber sections, images of the microtomed sections were photographed. A normal to the fabric surface and the orientation of the polyester component A in each fiber section were indicated in respective lines on the images to measure the angle made by the two lines. The number of fibers which were within the limits of ±20 degrees in this angle was counted. The count was divided by the total number of fibers thus checked for the angle to obtain a percentage, which was expressed as the fiber section orientation.

(11) Evaluation of appearance (look) and hand resulting from ironing

The fabric was ironed according to JIS L 1057/7.1.1, Method A-1. More specifically, an iron with a temperature of 220° C. was reciprocatingly moved three times on a test piece, 15 cm×15 cm, in the weft direction at a speed of 10 cm/sec under a pressure of about 30 kg/cm$^2$. A sensory test was thereafter conducted on the test piece by ten panelists.

The test piece was checked, for example, for undesirable gloss and other faults due to ironing, and the appearance was evaluated according to the criteria of: "100% satisfactory appearance with no change in the fabric surface" as represented by a circle mark, "70–99% satisfactory appearance with some changes in the fabric surface" as represented by a triangle mark, and "less than 70% satisfactory appearance with marked changes in the fabric surface" as indicated by a cross mark.

As to changes, such as hard or firm hand, due to ironing, the hand was evaluated according to the criteria of: "100% satisfactory hand with no change in hand" as represented by a circle mark, "70–99% satisfactory hand with some change such as slight hardening" as represented by a triangle mark, and "less than 70% satisfactory hand with a marked change such as hardening" as represented by a cross mark.

Example 1-(1)

Used as the highly shrinkable component A was a copolymerized polyester consisting primarily of ethylene terephthalate units and comprising 1.5 mole % of 5-sodium sulfoisophthalate-diethylene glycol ester and 8 mole % of isophthalic acid copolymerized therewith. Polyethylene terephthalate was used as the other component, i.e., the less shrinkable component B. The components were spun in a ratio of 50:50, at a temperature of 290° C., at a single-spinneret extrusion rate of 1 g/min and at a spinning speed of 1600 m/min to prepare undrawn filaments of the side-by-side type. The undrawn filaments were bundled and drawn to a ratio of 2.6 times at a temperature of 140° C. Next, the filaments were mechanically given 10 crimps/inch in a stuffing box and cut to equal lengths to prepare a staple of eccentric composite fibers of the side-by-side type, 51 mm in fiber length and 2.5 denier in fineness. The staple of composite fibers was 8% in dry heat shrinkage percentage in dry heat of 160° C. under a load of 36 mg/d. A treatment in dry heat of 160° C. free of load developed 55 crimps/inch in the staple.

Spun yarns (3.2 in twist constant), 30' s/1 in English yarn count, were prepared from 100 wt. % of the staple by the cotton spinning system.

The spun yarns were used as warps and wefts for producing a fabric of twill weave 2/1 which was 105 yarns/inch in warp density and 74 yarns/inch in weft density. The fabric was then treated in dry heat of at least 125° C. with an overfeed ratio of plus 45% in the warp direction and in a tension-free state in the weft direction, further processed for a reduction of 5% and dyed at 130° C. to obtain a fabric of Example 1-(1).

EXAMPLE 1-(2)

A fabric was produced by the same procedure as in Example 1-(1) with the exception of using blended yarns prepared from 65 wt. % of the same staple of eccentric composite fibers as used in Example 1-(1) and 35 wt. % of staple (2.5 denier×51 mm) of polyethylene terephthalate fibers.

Comparative Example 1-(1)

A fabric was produced by the same procedure as in Example 1-(1) with the exception of using blended yarns prepared from 50 wt. % of the same staple of eccentric composite fibers as used in Example 1-(1) and 50 wt. % of staple (2.5 denier×51 mm) of polyethylene terephthalate fibers.

COMPARATIVE EXAMPLE 1-(2)

Spun yarns (2.3 in twist constant), 30' s/1 in English yarn count, were prepared by the cotton spinning system from 100 wt. % of the same staple of eccentric composite fibers as used in Example 1-(1). A fabric was thereafter produced from the spun yarns by the same procedure as in Example 1-(1).

COMPARATIVE EXAMPLE 1-(3)

Spun yarns (5.0 in twist constant), 30' s/1 in English yarn count, were prepared by the cotton spinning system from 100 wt. % of the same staple of eccentric composite fibers as used in Example 1-(1). A fabric was thereafter produced from the spun yarns by the same procedure as in Example 1-(1).

COMPARATIVE EXAMPLE 1-(4)

Spun yarns (3.2 in twist constant), 30' s/1 in English yarn count, were prepared by the cotton spinning system from 100 wt. % of the same staple of eccentric composite fibers as used in Example 1-(1). The spun yarns were used as warps and wefts for producing a fabric (9.4 in coefficient of basic density) of twill weave 2/1 which was 37 yarns/inch in warp density and 25 yarns/inch in weft density. The same procedure as in Example 1-(1) thereafter followed to produce a fabric.

COMPARATIVE EXAMPLE 1-(5)

Spun yarns (3.2 in twist constant), 30' s/1 in English yarn count, were prepared by the cotton spinning system from 100 wt. % of the same staple of eccentric composite fibers as used in Example 1-(1). The spun yarns were used as warps and wefts for producing a fabric (9.4 in coefficient of basic density) of twill weave 2/1 which was 143 yarns/inch in warp density and 96 yarns/inch in weft density. The same procedure as in Example 1-(1) thereafter followed to produce a fabric.

COMPARATIVE EXAMPLE 1-(6)

A fabric woven by the same method as in Example 1-(1) was treated in dry heat of at least 125° C., as overfed by plus 5% in the warp direction and plus 5% in the weft direction, and thereafter processed in the same manner as in Example 1-(1) to prepare a fabric.

COMPARATIVE EXAMPLE 1-(7)

A fabric woven by the same method as in Example 1-(1) was treated in dry heat of at least 125° C., as overfed by plus 45% in the warp direction and held free in the weft direction, and thereafter processed to achieve a reduction of 43% and dyed at 130° C. to prepare a fabric.

The fabrics produced in the foregoing examples and comparative examples were tested for properties such as elongation percentage and recovery percentage of elongation. Table 1 shows the results along with the properties of the spun yarns.

TABLE 1

| | | Example | | Comparative Example | | | | | | |
|---|---|---|---|---|---|---|---|---|---|---|
| | | 1-(1) | 1-(2) | 1-(1) | 1-(2) | 1-(3) | 1-(4) | 1-(5) | 1-(6) | 1-(7) |
| Blending ratio | Composite fibers (wt. %) | 100 | 65 | 50 | 100 | 100 | 100 | 100 | 100 | 100 |
| | Polyethylene terephthalate fiber (wt. %) | 0 | 35 | 50 | 0 | 0 | 0 | 0 | 0 | 0 |
| Spun yarns | Dry heat shrinkage (%) 160 deg C. | 45 | 34 | 25 | 22 | 39 | 45 | 45 | 45 | 45 |

TABLE 1-continued

| | | | Example | | Comparative Example | | | | | | |
|---|---|---|---|---|---|---|---|---|---|---|---|
| | | | 1-(1) | 1-(2) | 1-(1) | 1-(2) | 1-(3) | 1-(4) | 1-(5) | 1-(6) | 1-(7) |
| Farbic | Weight (g/cm$^2$) | | 182 | 242 | 187 | 171 | 176 | 112 | 272 | 163 | 129 |
| | Thickness (mm) | | 0.71 | 0.83 | 0.69 | 0.66 | 0.68 | 0.41 | 0.89 | 0.59 | 0.58 |
| | Coefficient of basic density | | 26.4 | 29.5 | 26.4 | 26.4 | 26.4 | 9.4 | 36.4 | 26.4 | 26.4 |
| | Elongation percentage | Warp | 25 | 18 | 16 | 21 | 18 | 22 | 4 | 13 | 12 |
| | | Weft | 28 | 21 | 24 | 24 | 20 | 17 | 6 | 16 | 14 |
| | Recovery percentage of elongation | Warp | 87 | 88 | 61 | 59 | 62 | 58 | 81 | 61 | 58 |
| | | Weft | 83 | 92 | 58 | 63 | 66 | 61 | 79 | 63 | 55 |
| | Stretchability | Warp | ○ | ○ | Δ | Δ | Δ | Δ | Δ | Δ | Δ |
| | | Weft | ○ | ○ | Δ | Δ | Δ | Δ | Δ | Δ | Δ |
| | Fiber section orientation (%) | | 72 | 80 | 66 | 71 | 59 | 68 | 48 | 58 | 42 |
| | Change in appearance | | ○ | ○ | ○ | ○ | ○ | Δ | X | Δ | X |
| | Change in hand | | ○ | ○ | ○ | Δ | Δ | Δ | X | Δ | Δ |

The results of Table 1 reveal the following. The fabrics of Examples 1-(1) and 1-(2) were great in both elongation percentage and recovery percentage of elongation and excellent in stretchability, and remained unchanged in appearance and hand.

On the other hand, the fabric of Comparative Example 1-(1), which was as small as 50 wt. % in the proportion of the eccentric composite fiber staple, was lower in elongation percentage and recovery percentage and inferior in stretchability. The fabric of Comparative Example 1-(2) was small in the twist constant of single yarns and therefore low in recovery percentage and changed in hand. The fabric of Comparative Example 1-(3) was excessively great in the twist constant of single yarns, therefore failed to exhibit satisfactory fiber section orientation, was low in recovery percentage, appeared altered and had hard hand. The fabric of Comparative Example 1-(4), which was greatly diminished in weave density, was low in recovery percentage and felt less resistant to stretching, exhibiting low stretchability. This fabric of Comparative Example 1-(4) had coarse hand and the problem of creating pulled stitches when repeatedly stretched. The fabric of Comparative Example 1-(5) had an excessively great weave density, failing to exhibit satisfactory fiber section orientation. Consequently, the fabric was small in elongation percentage and felt excessively resistant to stretching, hence poor stretchability. This fabric of Comparative Example 1-(5), had hard hand. The fabric of Comparative Example 1-(6), which was processed as relaxed insufficiently, failed to exhibit satisfactory fiber section orientation and was consequently low in both elongation percentage and recovery percentage, hence low stretchability. The fabric was faulty also in appearance and hand. With Comparative Example 1-(7), an excessive reduction entailed a lower recovery percentage and impaired stretchability. The fabric further had excessively soft hand.

EXAMPLE 2

In some of the examples to follow, properties of yarns and fabrics were determined by the following methods. Wefts were checked in the form of spun yarns for total shrinkage percentage by applying the method of JIS L 1015/7.15. The fabrics were checked for weight according to the method of JIS L 1096/6.4, for thickness by the method of JIS L 1096/6.5, for elongation percentage by the method of JIS L 1096/6.14.1, and for recovery percentage of elongation by the method of JIS L 1096/6.14.2.

EXAMPLE 2-(1)

Used as the highly shrinkable component A was a highly shrinkable copolymerized polyester comprising 1.5 mole % of 5-sodium sulfoisophthalate-diethylene glycol and 8 mole % of isophthalic acid copolymerized therewith. Polyethylene terephthalate was used as the other component, i.e., the less shrinkable component B. The components were spun in a ratio of 50/50 through each of spinnerets at the same time, at a temperature of 290° C., at a single-spinneret extrusion rate of 1 g/min and at a spinning speed of 1600 m/min to prepare undrawn composite fibers of the side-by-side type. The undrawn fibers were bundled into a tow (a bundle of continuous fibers), which was then drawn to a ratio of 2.3 times in length at a temperature of 140° C. The resulting composite fibers were forced into a stuffing box, mechanically crimped and subsequently cut to obtain a staple of composite fibers, 2.5 denier in fineness and 51 mm in fiber length and having 10 crimps/inch. When treated in dry heat of 160° C. free of load, the composite fibers developed 48 crimps/inch.

Spun yarns, 15 in English yarn count and 3.2 in twist constant, were prepared only from such composite fibers by the usual short fiber spinning process. A fabric of twill weave 2/1, 71 yarns/inch in warp density and 54 yarns/inch in weft density, was woven from the spun yarns used as wefts and spun yarns made of polyethylene terephthalate, 15 in English yarn count and serving as warps. The fabric was thereafter processed for a reduction of 10% and dyed at 130° C. to obtain a fabric.

EXAMPLE 2-(2)

The same staple of composite fibers as prepared in Example 2-(1) and a usual polyester staple (2.0 denier in fineness and 51 mm in fiber length) were spun as blended in a ratio of 65/35 to obtain spun yarns, 15 in English yarn count and 3.2 in twist constant. The same procedure as in Example 2-(1) thereafter followed to produce a fabric using the spun yarns.

COMPARATIVE EXAMPLE 2-(1)

The same staple of composite fibers as prepared in Example 2-(1) and a usual polyester staple (2.0 denier in fineness and 51 mm in fiber length) were spun as blended in a ratio of 50/50 to obtain spun yarns, 15 in English yarn count and 3.2 in twist constant. The same procedure as in Example 2-(1) thereafter followed to produce a fabric using the spun yarns.

The fabrics obtained in Examples 2-(1) and 2-(2), and Comparative Example 2-(1) were checked for properties. Table 2 shows the results obtained along with the stretchability of the fabrics evaluated by a sensory test and the total shrinkage percentage of the wefts of the fabrics.

TABLE 2

| | Example | | Comparative Example |
|---|---|---|---|
| | 2-(1) | 2-(2) | 2-(1) |
| Ratio of compositive fibers blended (%) | 100 | 65 | 50 |
| Ratio of usual fibers blended (%) | 0 | 35 | 50 |
| Total shrinkage of wefts (%) | 38 | 30 | 21 |
| Weight of fabric (g/m$^2$) | 318 | 297 | 270 |
| Thickness of fabric (mm) | 0.59 | 0.55 | 0.50 |
| Recovery percentage of elongation of the fabric (%) | 26 | 14 | 4.8 |
| Stretchability | ○ | ○ | X |

Table 2 reveals that the fabrics of Examples 2-(1) and 2-(2) were great in elongation and recovery percentage of elongation, hence high stretchability. On the other hand, the fabric of Comparative Example 2-(1), comprising as blended composite fibers of the same type as used in Examples 2-(1) and 2-(2), was small in elongation percentage and recovery percentage and inferior in stretchability since the blending ratio was as low as 50%.

EXAMPLE 2-(3)

A fabric of twill weave 1/2, 71 yarns/inch in warp density and 43 yarns/inch in weft density, was woven from warps and wefts which were spun yarns of the same type as those used as the wefts in Example 2-(1), i.e., spun yarns having an English count of 15 and consisting only of composite fibers. The fabric was thereafter processed in the same manner as in Example 2-(1) to produce a fabric.

The fabric of Example 2-(3) was checked for properties and subjected to a sensory test for the evaluation of stretchability. Table 3 shows the results.

TABLE 3

| | Example 2-(3) |
|---|---|
| Weight (g/m$^2$) | 325 |
| Thickness (mm) | 0.61 |
| Elongation percentage in warp direction (%) | 32 |
| Elongation percentage in weft direction (%) | 28 |
| Recovery percentage of elongation in warp direction (%) | 91 |
| Recovery percentage of elongation in weft direction (%) | 92 |
| Stretchability | ○ |

Table 3 reveals that the fabric of Example 2-(3) was great in elongation percentage and recovery percentage in both the warp and weft directions, exhibiting excellent stretchability.

EXAMPLE 3

The weft used was a slub yarn. In the examples and comparative examples to follow, slub yarns were tested for characteristics by the following methods.

(1) Elongation percentage of slub yarn

First, the sample yarn was treated in dry heat at 160° C. for 30 minutes and thereafter allowed to stand for 1 minute with a load of 0.056 gf/denier applied to the yarn. Using the resulting length L1 measured and the original length L0, the elongation percentage of the slub yarn is given by:

$$[(L1-L0)/L0]\times 100.$$

(2) Recovery percentage of elongation of slub yarn

First, the sample yarn was treated in dry heat at 160° C. for 30 minutes and thereafter allowed to stand for 1 hour with a load of 0.056 gf/denier applied to the yarn. The resulting length L1 was then measured. The yarn was subsequently allowed to stand for 1 hour with the load removed, whereupon the yarn was checked again for the resulting length L2. Using the lengths L1, L2and the original length L0, the recovery percentage of the slub yarn was given by:

$$[(L1-L2)/(L1-L0)]\times 100.$$

(3) Dry heat shrinkage percentage of staple

Determined according to the method of JIS L 1015 7.15. The fibers of the sample, measuring 25 mm in length and as loosened, were individually adhered at their opposite ends to smooth-surfaced paper. The sample was then attached to a suspending device, with clamps thereof spaced apart by a suitable distance. The paper having the sample affixed thereto was cut, a load of 36 mg/d was thereafter applied to the sample, and the distance L between the clamps was measured. The sample was then removed from the device, held suspended in a dryer at a temperature of 160° C. for 30 minutes, subsequently withdrawn from the dryer, allowed to cool to room temperature, and thereafter subjected to the same load as above to measure the distance L' between the clamps. Using the values L and L', the dry heat shrinkage percentage was given by:

$$[(L-L)/L]\times 100.$$

(4) Dry heat shrinkage percentage of slub yarn

The sample slub yarn was attached to a suspending device with the distance between its clamps set to 50 cm. With a load of 140 mg/d applied to the slub yarn, the distance H between the clamps was measured. The slub yarn was then removed from the device, held suspended in a dryer at a temperature of 160° C. for 30 minutes, thereafter taken out from the dryer, allowed to cool, and subjected to the same load as above to measure the distance H' between the clamps. Using the valves H and H', the dry heat shrinkage percentage was given by:

$$[(H-H')/H]\times 100.$$

(5) Appearance (look)

The sample fabric was checked for appearance with the unaided eye by ten panelists for evaluation. The circle mark stands for a satisfactory appearance.

(6) Stretchability

A sensory test was conducted on the sample by ten panelists for evaluation. The circle mark indicates that the sample was satisfactory in elongation and gave an agreeable resisting feel when stretched.

EXAMPLE 3-(1)

Figure 5:
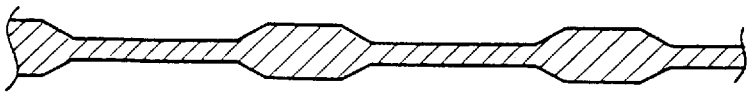
FIG. 5 is a view in longitudinal section of a slub yarn.
Figure 6:
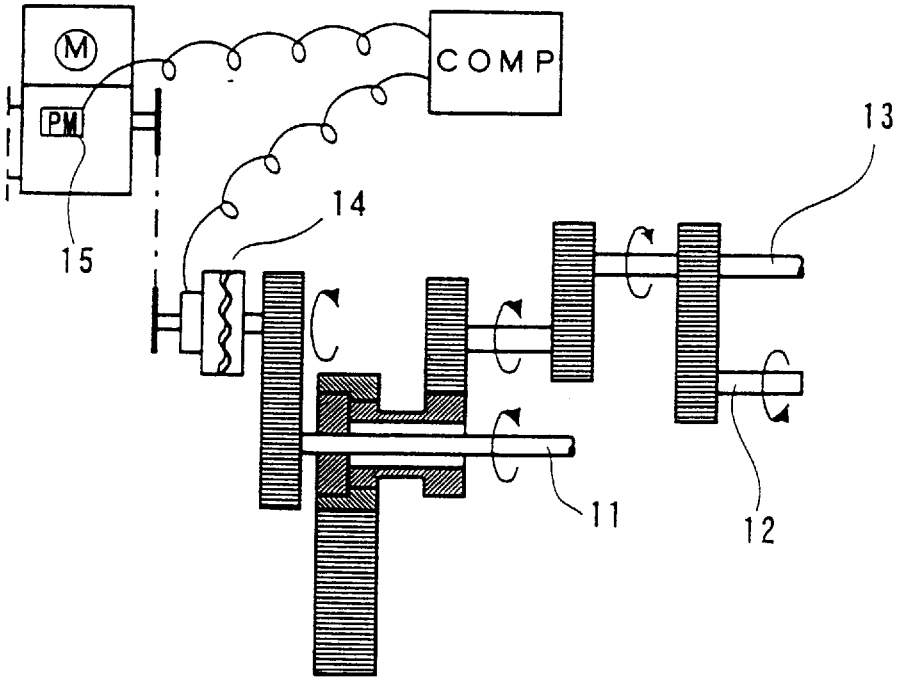
FIG. 6 is a diagram showing an example of apparatus for producing the slub yarn.

FIG. 5 is a view in longitudinal section of the slub yarn used in the present example. FIG. 6 is a diagram showing an example of ring spinning frame used for preparing the slub yarn. Indicated at 11 in the diagram is a front bottom roller, at 12 a middle bottom roller, at 13 a back bottom roller, at 14 a clutch and at 15 a pilot motor. The slub yarn for use in this example was prepared by the following method. First, a staple of eccentric composite fibers of the side-by-side type was produced in the same manner as in Example 1-(1). The staple was made into a roving, which was then fed to the ring spinning frame shown in FIG. 6 to prepare a slub yarn under the following conditions.

Spinning Conditions

Spinning speed: 4 m/min for slub sections, 9–11 m/min for the other sections

Speed of rotation of the front bottom roller 11: 51 rpm for slub sections, 115–138 rpm for the other sections Speed of rotation of the middle bottom roller 12: 10.5 rpm (low speed)

Speed of rotation of the back bottom roller 13: 4.5 rpm (high speed)

Clutch (14) off time: 0.5–75 sec

Motor (15) rotation reversing period: 5 sec

Clutch (14) on time: 4–28 sec

The slub yarn thus obtained was used as it was for producing a fabric of plain weave as the weft without steam setting. The warp used was a usual spun yarn comprising eccentric composite polyester fibers. The fabric was thereafter processed for a reduction of 5% and dyed at 130° C. The fabric obtained was satisfactory in stretchability and had a diversified appearance and soft hand.

The slub yarn used in Example 3-(1) was checked for characteristics. Table 4 shows the result.

TABLE 4

| | Example | | Comparative Example | | |
|---|---|---|---|---|---|
| | 3-(1) | 3-(2) | 3-(1) | 3-(2) | 3-(3) |
| Fiber material | polyester | polyester | polyester | polyester | polyester nylon |
| Composite fiber blending ratio (%) | 100 | 65 | 50 | 0 | |
| Sublength (mm) | 1~60 | 1.5~60 | 2~55 | 2~60 | 0.5~70 |
| Slub thickness (mm) | 0.5~2.0 | 0.5~1.5 | 0.6~2.0 | 0.6~2.0 | 0.3~3.5 |
| Elongation percentage (%) | 75 | 38 | 28 | — | 180 |
| Recovery percentage of elongation (%) | 98 | 98 | 99 | — | 90 |
| Dry heat shrinkage (%) | 45 | 34 | 25 | 5 | 10 |
| Stretchability | ○ | ○ | Δ | X | ○ |
| Apperance | ○ | ○ | ○ | ○ | X |
| Processability | ○ | ○ | ○ | ○ | X |
| Cost | ○ | ○ | ○ | ○ | X |

EXAMPLE 3-(2)

A slub yarn was prepared from a blended yarn comprising 65 wt. % of the same staple of eccentric composite fibers as used in Example 3-(1) and 35 wt. % of a usual polyester staple. A fabric was woven from the slub yarn. The same conditions as in Example 3-(1) were used for spinning the slub yarn and preparing the fabric. Table 4 also shows the characteristics determined of the slub yarn used in this example.

COMPARATIVE EXAMPLE 3-(1)

A slub yarn was prepared from a blended yarn comprising 50 wt. % of the same staple of eccentric composite fibers as used in Example 3-(1) and 50 wt. % of a usual polyester staple. A fabric was woven from the slub yarn. The same conditions as in Example 3-(1) were used for spinning the slub yarn and preparing the fabric. Table 4 also shows the characteristics determined of the slub yarn used in this example.

COMPARATIVE EXAMPLE 3-(2)

A slub yarn was prepared from a usual polyester staple in place of the eccentric composite fiber staple of Example 3-(1). A fabric was woven from the slub yarn. The same conditions as in Example 3-(1) were used for spinning the slub yarn and preparing the fabric. Table 4 also shows the characteristics determined of the slub yarn used in this example.

COMPARATIVE EXAMPLE 3-(3)

A fancy yarn having fineness irregularities was prepared by using spandex for the core, covering the core with a nylon filament yarn which was fed at varying speeds and giving varying twist numbers. However, it was impossible to provide the covering around the core with good stability since the core was stretchable, and to give a stabilized shape over the yarn surface. The yarn therefore had a very poor quality. Table 4 also shows the characteristics of the fancy yarn determined.

We claim:

1. A highly stretchable fabric having an elongation percentage of 5 to 45% and a recovery percentage of elongation of at least 70% and comprising spun yarns serving at least as warps or wefts, the fabric being characterized in that the spun yarns contain two-component composite fibers comprising a highly shrinkable polyester component A and a polyester component B less shrinkable than the polyester component A, the composite fibers being so oriented that in the vicinity of the crests of weaving crimps of the spun yarn, the polyester component A faces toward the inner side of the crimps.

2. A highly stretchable fabric according to claim 1 characterized in that the spun yarns contain the two-component composite fiber in an amount of at least 55 wt. %.

3. A highly stretchable fabric according to claim 1 characterized in that the two-component composite fibers are eccentric composite fibers.

4. A highly stretchable fabric according to claim 3 characterized in that the eccentric composite fibers are composite fibers wherein the highly shrinkable polyester component A and the less shrinkable polyester component B are joined in the form of a bimetal.

5. A highly stretchable fabric according to claim 3 characterized in that the highly shrinkable polyester component A is a copolymerized polyester formed from an aromatic dicarboxylic acid and a fatty acid or aromatic diol and composed of units at least 80% of which are ethylene terephthalate units, the less shrinkable polyester component B being a copolymerized polyester less shrinkable than the highly shrinkable polyester component A and consisting primarily of polyethylene terephthalate or ethylene terephthalate units.

6. A highly stretchable fabric according to claim 3 characterized in that the highly shrinkable polyester component A is a copolymerized polyester consisting primarily of ethylene terephthalate units and comprising 1 to 3 mole % of component units having a metal salt sulfonate group and 2 to 10 mole % of isophthalic acid as copolymer components, the less shrinkable polyester component B being a copolymerized polyester less shrinkable than the polyester component A and consisting primarily of polyethylene terephthalate or ethylene terephthalate units.

7. A highly stretchable fabric according to claim 3 characterized in that the eccentric composite fibers are polyester composite fibers having a latent crimping property and at least 5% in dry heat shrinkage percentage in dry heat of 160° C. under a load of 36 mg/d and at least 40/inch in the number of crimps to be produced in dry heat at 160° C. with no load applied thereto.

8. A highly stretchable fabric according to claim 1 characterized in that the spun yarn is at least 20% in dry heat shrinkage percentage at 160° C.

9. A highly stretchable fabric according to claim 1 characterized in that the spun yarn is a stretchable slub yarn.

10. A highly stretchable fabric according to claim 1 characterized in that the fabric is 20 to 45% in elongation percentage.

11. A highly stretchable fabric according to claim 1 characterized in that the fabric is 50 to 800 g/m$^2$ in weight and 0.15 to 2.4 mm in thickness.

12. A highly stretchable fabric according to claim 1 characterized in that at least 60% of the two-component fibers have the orientation.

13. A process for producing a highly stretchable fabric characterized in that the process comprises the steps of preparing spun yarns containing at least 55 wt. % of composite fibers having a latent crimping property and comprising a polyester component A and a polyester component B less shrinkable than the polyester component A, preparing a fabric ranging from 10 to 35 in the coefficient of basic density represented by Equation (2) given below with use of the spun yarns at least as warps or wefts so that the weight proportion of the spun yarns in the entire fabric is 25 wt % to 100 wt. %, and heat-treating the fabric at least before, during or after dyeing in wet heat of at least 125° C. or dry heat of at least 160° C. in a free state, the spun yarns being 3.2 to 4.7 in the twist constant determined from Equation (1) given below when the spun yarns are single yarns, or 3.2 to 4.7 in the twist constant of first twist and 0.5 to 1.5 times the first twist constant in the twist constant of final twist in the same direction as the first twist when the spun yarns are plied yarns $$\text{Twist constant}=T/(Ne)^{1/2} \tag{1}$$

wherein T is the twist number per inch of the spun yarns, and Ne is the English count of the spun yarns $$\text{Coefficient of basic density} = \{2n/(2\,(Nw)^{1/2}) + St/(2\,(Nt)^{1/2})\} \times T/St + \{2n/(2\,(Nt)^{1/2}) + Sw/(2\,(Nw)^{1/2})\} \times W/Sw \tag{2}$$

wherein n is the number of the crossover points of yarns in one cycle, Nt is the count of the warps, Nw is the count of the wefts, T is warp density (yarns/inch), W is weft density (yarns/inch), St is the number of warps in one cycle, and Sw is the number of wefts in one cycle.

14. A process for producing a highly stretchable fabric according to claim 13 characterized in that the fabric is in the free state by being overfed by plus 10% in both warp and weft directions.

15. A process for producing a highly stretchable fabric according to claim 13 characterized in that the process further includes the step of processing the fabric to achieve a reduction of up to 40% at least before or after the heat-treating step.

16. A process for producing a highly stretchable fabric according to claim 13 characterized in that the eccentric composite fibers are polyester composite fibers at least 5% in dry heat shrinkage percentage in dry heat of 160° C. under a load of 36 mg/d and at least 40/inch in the number of crimps to be produced in dry heat at 160° C. with no load applied thereto.

17. A process for producing a highly stretchable fabric according to claim 13 characterized in that the spun yarns are at least 20% in dry heat shrinkage percentage at 160° C.

* * * * *